United States Patent [19]

Theurer et al.

[11] Patent Number: 5,074,219

[45] Date of Patent: Dec. 24, 1991

[54] MACHINE FOR DETACHING TIE ANCHORS

[75] Inventors: Josef Theurer, Vienna; Herbert Wörgötter, Linz, both of Austria

[73] Assignee: Fanz Plasser Bahnbaumaschinen-Industriegesellschaft M.B.H., Vienna, Austria

[21] Appl. No.: 605,974

[22] Filed: Oct. 30, 1990

[51] Int. Cl.[5] ..... E01B 29/32

[52] U.S. Cl. ..... 104/17.2; 104/2

[58] Field of Search ..... 104/17.2, 2

[56] References Cited

U.S. PATENT DOCUMENTS 4,319,392 3/1982 Cutts ..... 104/17.2 X 4,580,501 4/1986 Collins et al. ..... 104/17.2 X

*Primary Examiner*—Robert J. Oberleitner

*Assistant Examiner*—Kevin D. Rutherford

*Attorney, Agent, or Firm*—Collard, Roe & Galgano

[57] ABSTRACT

A machine for detaching tie anchors from the rails of a railroad track comprises a self-propelled machine frame mounted on undercarriages for movement along the track in an operating direction, and two workheads mounted on the machine frame and positioned opposite each other in a direction extending transversely to the machine frame. Each workhead is associated with a respective rail for detaching the tie anchors therefrom and comprises a hammer arranged to press against a field-side tie anchor end, and drives for adjusting the hammer vertically and in a direction extending longitudinally with respect to the machine frame for pressing the hammer against the field-side tie end.

18 Claims, 2 Drawing Sheets

Fig.4
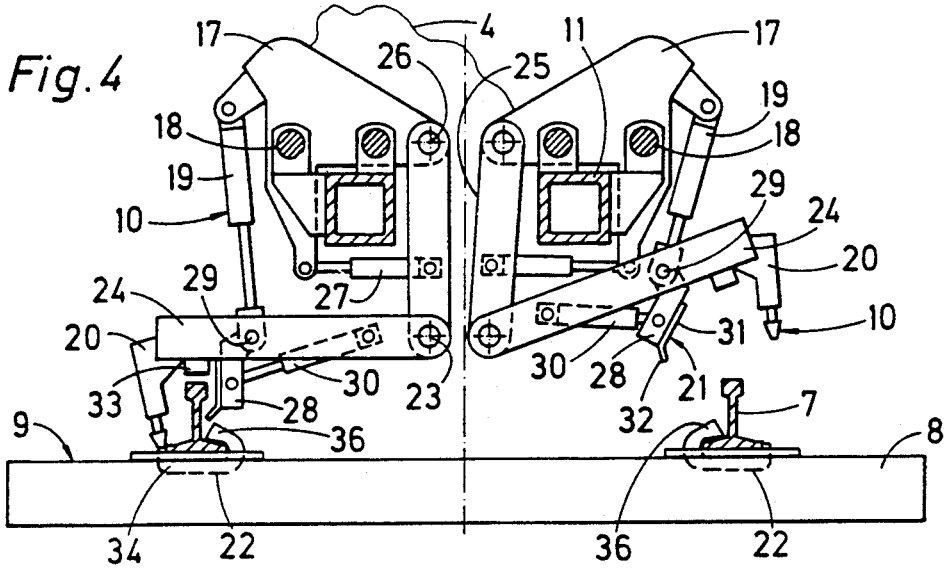
Fig.5
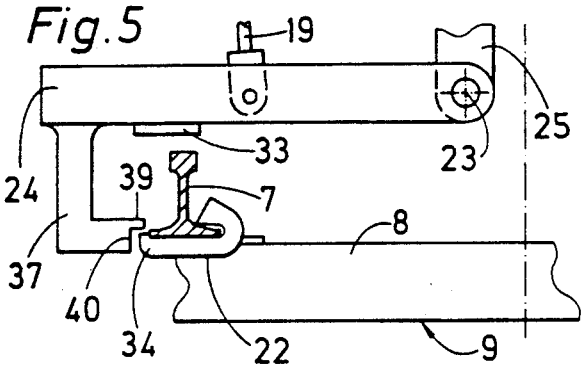
Fig.6
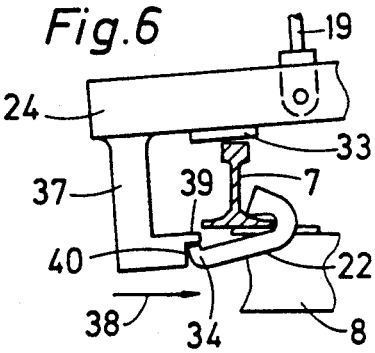
Fig.7
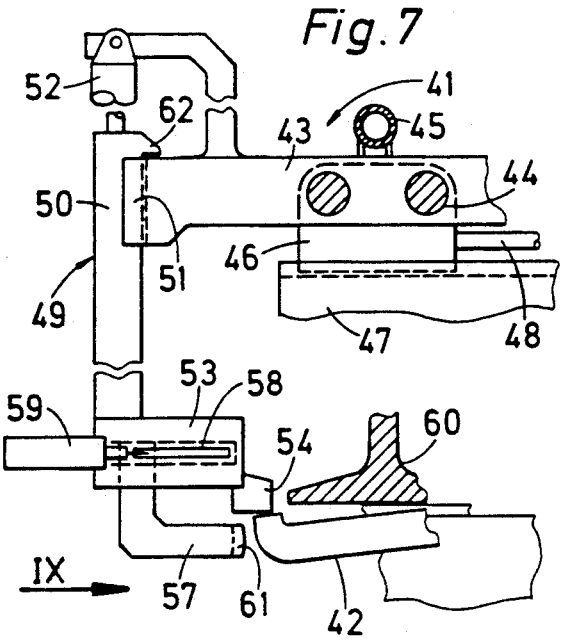
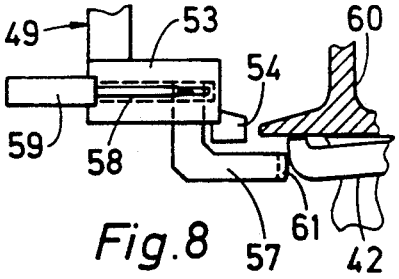
Fig.8
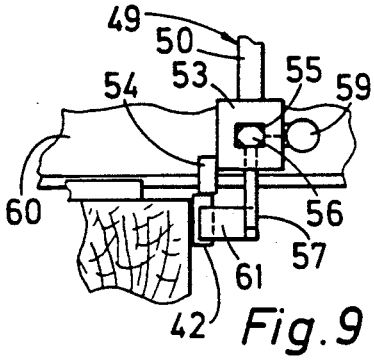
Fig.9

MACHINE FOR DETACHING TIE ANCHORS

BACKGROUND OF THE INVENTION

1. Field of the Invention

The present invention relates to a machine for detaching tie anchors from the rails of a railroad track comprising two rails fastened to ties, each rail consisting of a head, a base and a web interconnecting the rail head and base, and having a field side and a gage side, and the tie anchors engaging the rail base and having one end at the field side of the rail and an opposite end at the gage side of the rail.

2. Description of the Prior Art

Such tie or rail anchors are affixed to the rail base to avoid relative displacement between rail and tie, and they must be detached from the rail before a tie held in position by the anchor is replaced. Heretofore, this has been done by operators manually hammering the tie anchors out of their engagement with the rail base, which involves hard work and is exceedingly inefficient.

SUMMARY OF THE INVENTION

It is the object of this invention to provide a machine for efficiently detaching tie anchors without involving manual labor.

This object is accomplished according to the invention with a machine comprising a self-propelled machine frame mounted on undercarriages for movement along the track in an operating direction, and two workheads mounted on the machine frame and positioned opposite each other in a direction extending transversely to the machine frame, each of the workheads being associated with a respective one of the rails for detaching the tie anchors therefrom and comprising a hammer arranged to press against the one tie anchor end, and drive means for adjusting the hammer vertically and in a direction extending longitudinally with respect to the machine frame for pressing the hammer against the one tie end.

With such a machine, it has for the first time become possible automatically and dependably to detach a tie anchor from the rail base it engages. The drive means can be rapidly and simply actuated to adjust the hammers longitudinally with respect to the machine frame to center them exactly above the field side end of each anchor and immediately thereafter to lower the longitudinally adjusted hammers into pressing engagement with this anchor end for detaching it from the edge of the rail base. Since this detached anchor end is then under stress with respect to the opposite, gage-side end of the anchor, the anchor will usually become entirely detached from the rail base after the one anchor end has been detached by the hammer. If this is not the case, a stripping element associated with the hammer and arranged oppositely thereto with respect to the rail at the gage side thereof may be used for fully detaching the anchor. Such a stripping element may be hook-shaped, for example.

In a preferred embodiment, the machine comprises two workheads associated with each rail, and the drive means comprises a respective drive connected independently to each workhead for longitudinally adjusting the workhead. This makes it possible to detach all four anchors of a tie from both rails in a single operation after the hammers have been individually centered with respect to each anchor.

The machine may further comprise a carrier frame for the workheads, the carrier frame extending in a direction extending longitudinally with respect to the machine frame and having one end linked to the machine frame, and flanged wheels supporting an opposite end of the carrier frame on the rails. The flanged wheels guiding the carrier frame for the workheads along the track will enable the workheads to be properly centered over the anchors in sharp curves.

If the machine further comprises a vertically adjustable magnetic tie anchor collecting device mounted on the machine frame rearwardly of each workhead in the operating direction, and a container for storing the collected tie anchors, the detached anchors can be immediately collected by, and stored, on the machine.

Rapid and exact centering of the workheads will be assured with a machine which further comprises an operator's cab mounted on the machine frame above the workheads, the cab having a width of at least 3 m and a transparent floor portion through which an operator in the cab may view the workheads.

In another preferred embodiment, the vertically adjustable hammer comprises a pressure element for engaging the one tie anchor end, a transversely displaceable stripping element, and a drive for transversely displacing the stripping element. This provides a simple structure and automatically assures proper positioning of the stripping element when the hammer is centered.

In a preferred embodiment, the machine comprising the self-propelled machine frame and two workheads comprising the hammer has a drive for adjusting the hammer vertically for pressing the hammer against the one tie end and partially detaching the tie anchor, a vertically and transversely displaceable stripping element associated with the hammer, and drive means for vertically and transversely displacing the stripping element for fully detaching the partially detached tie anchor. Combining the vertically adjustable hammer with the vertically and transversely displaceable stripping element assures a trouble-free anchor detaching operation and, most of all, provides for the rapid detachment and immediate removal of the anchor from the tie. In operation, the hammer is first pressed down against the field-side end of the anchor to detach it from the edge of the rail base and the stripping element is then displaced transversely towards the center of the track to remove the anchor fully from the rail base. In this manner, even anchors which tend to adhere to the rail base due to internal stress or because of rust are dependably detached.

According to a preferred feature, the stripping element comprises an abutment face arranged to extend substantially vertically for engagement with the rail head in a vertically and transversely adjusted stripping position of the stripping element, and a short end portion projecting from the abutment face towards the associated hammer at an obtuse angle to the abutment face. The abutment face will accurately delimit the transverse displacement of the stripping element to position the projecting end portion thereof between the rail web and the anchor.

According to a preferred embodiment, the machine further comprises a pivotal carrier arm for each hammer and associated stripping element, the carrier arm being pivotal about an axis extending in a longitudinal direction, and the drive is connected to the carrier arm for pivoting the arm and adjusting the hammer vertically. This has the advantage that the single pivoting motion of the carrier arm will place the hammer and the stripping element in the desired operating position.

In this embodiment, the stripping element arranged transversely opposite the hammer with respect to the rail for pressing against the rail head at the gage side of the rail is preferably mounted on the carrier arm for pivoting about an axis extending in a longitudinal direction, and the drive means comprises a drive mounted on the carrier arm for transversely displacing the stripping element for fully detaching the partially detached tie anchor. This simple construction enables the stripping element to be inserted precisely in the small area between the rail web and the hookshaped anchor end engaging the rail base so that the same may be readily and dependably detached from the rail.

The carrier arm extends transversely with respect to the machine frame, and the hammer and stripping element are mounted at one end of the transversely extending carrier arm, and the machine may further comprise a substantially vertically extending lever arm having one end to which an end of the carrier arm opposite to the one carrier arm end is linked, a workhead carrier to which an end of the lever arm opposite to the one lever arm end is linked at a pivot extending longitudinally with respect to the machine frame, and a drive linking the lever arm to the workhead carrier for pivoting the lever arm. This enables the hammer and stripping element to be slightly transversely adjusted for centering the hammer accurately over the narrow field-side end of the anchor.

Preferably, the carrier arm comprises an abutment arranged to engage the running surface of the rail head upon pivoting the carrier arm vertically donwardly towards the rail. This accurately delimits the downward motion of the carrier arm when the hammer is pressed against the anchor so that the stripping element, which is operated immediately thereafter, is in the correct operating position just above the rail base.

If the hammer is cylindrical and the longitudinal hammer axis encloses an angle of about 60° to 80° with the pivotal arm, an operator will be able to view the pressure end of the hammer unhindered for exact centering and any slight transverse adjustment thereof. cl

BRIEF DESCRIPTION OF THE DRAWING

The above and other objects, advantages and features of the present invention will be described in detail in connection with certain now preferred embodiments thereof, taken in conjunction with the accompanying, partly schematic drawing wherein

FIG. 4 shows an end view of two transversely opposite workheads respectively associated with each rail, taken along transverse section line IV of FIG. 1;

FIGS. 5 and 6 are fragmentary end views showing another embodiment of the workhead in successive operating stages;

FIGS. 7 and 8 are like fragementary end views showing a further embodiment of the workhead in successive operating stages; and FIG. 9 is a fragmentary side elevational view taken in the direction of arrow IX of FIG. 7.

DETAILED DESCRIPTION OF PREFERRED EMBODIMENTS

Figure 1:
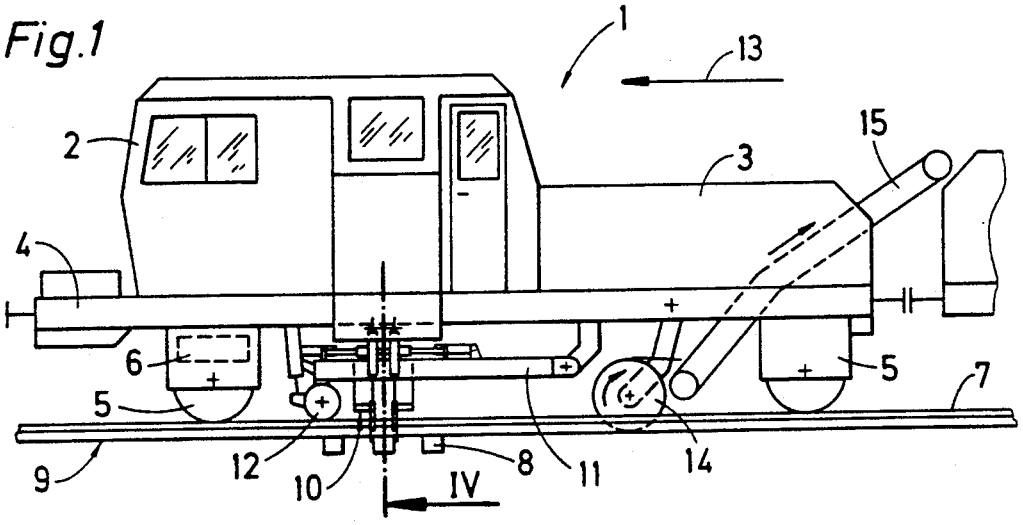
FIG. 1 is a side elevational view of a machine for detaching tie anchors from the rails of a railroad track, showing the workheads mounted between the undercarriages supporting the machine for movement along the track.

Referring now to the drawing and first to FIGS. 1 to 4, there is shown machine 1 for detaching tie anchors 22 from the rails 7 of railroad track 9 comprising two rails fastened to ties 8. Each rail consists of a head, a base and a web interconnecting the rail head and base, and has a field side facing outwardly of track 9 and a gage side facing inwardly towards the track center. The tie anchors engage the rail base and have one end 34 at the field side of the rail and an opposite end at the gage side of the rail. The illustrated machine comprises self-propelled machine frame 4 mounted on undercarriages 5 for movement along track 9 in an operating direction indicated by arrow 13. The machine frame carries power plant 3 supplying energy to the operating drives of the machine, including drive 6 for propelling the machine along the track.

Workheads 10 are mounted on machine frame 4 between undercarriages 5. In the illustrated embodiment, two workheads are associated with each rail 7 and respective workheads at each rail are positioned opposite each other in a direction extending transversely to the machine frame for detaching tie anchors 22 from the rails. Each workhead comprises hammer 20 arranged to pres against the field-side tie anchor end, and drive means 16, 19 adjust the hammer vertically and in a direction extending longitudinally with respect to the machine frame for pressing the hammer against the field-side tie end. The illustrated drive means comprises respective drive 16 connected independently to each workhead 10 for longitudinally adjusting the workhead. The machine further comprises carrier frame 11 for workheads 10, the carrier frame extending in a direction extending longitudinally with respect to machine frame 4 and having one end linked to the machine frame. Flanged wheels 12 support an opposite end of carrier frame 11 on rails 7.

The illustrated machine further comprises vertically adjustable magnetic tie anchor collecting device 14 mounted on machine frame 4 rearwardly of each pair of workheads 10 in the operating direction, and a container for storing the collected tie anchors. Each tie anchor collecting device is independently vertically adjustably mounted adjacent the field side of each rail 7 and comprises a magnetizable rotary drum rotatable about a transverse axis for collecting the detached tie anchors, and the magnetized surface portion of the drum whereon the anchors have been collected is demagnetized when it is rotated into a position abutting conveyor 15 to place the anchors on the conveyor which conveys them to a container coupled to the machine.

As shown, the machine further comprises operator's cab 2 mounted on machine frame 4 above workheads 10, the cab having a width of at least 3 m and a transparent floor portion through which an operator in the cab may view the workheads.

Figure 2:
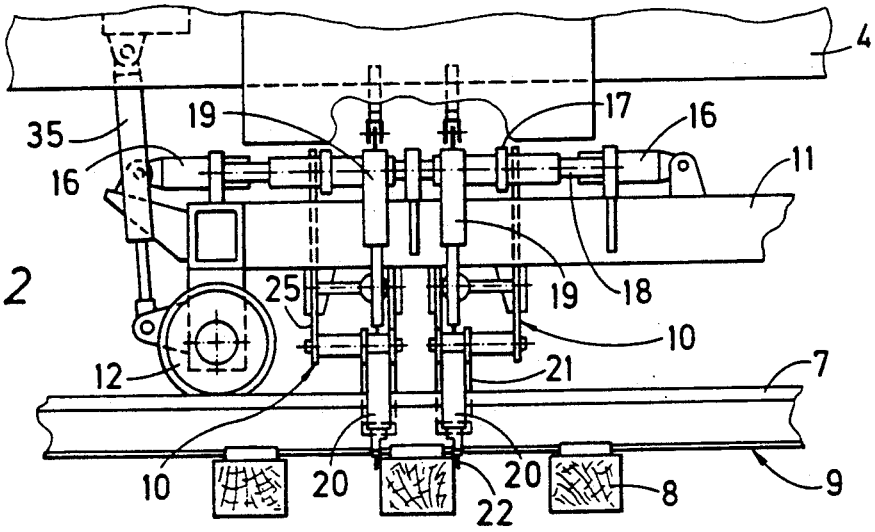
FIG. 2 is an enlarged fragmentary side elevational view of the machine, illustrating the two workheads associated with a rail in greater detail.
Figure 3:
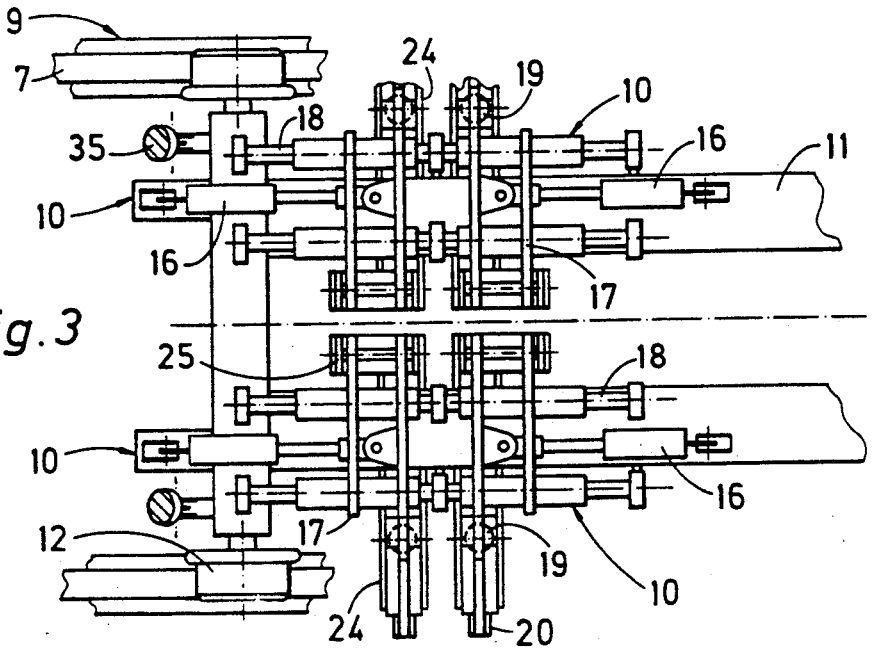
FIG. 3 is a top view of the workheads illustrated in FIG. 2.

Operating workheads 10 are more clearly illustrated in FIGS. 2 to 4. As shown, each hammer 20 is arranged at respective rail 7 to press against the one tie anchor end at the field side of the rail, and drive 19 adjusts the hammer vertically for pressing the hammer against the one tie end and partially detaches the tie anchor upon downward movement of the hammer. Vertically and transversely displaceable stripping element 21 is associated with each hammer at the gage side of the associated rail, and drive means 19 vertically and transversely displaces the stripping element for fully detaching the partially detached tie anchor. Each workhead has a carrier 17 which is longitudinally displaceably mounted on longitudinally extending guide rods 18 affixed to carrier frame 11 and respective drive 16 is connected independently to each workhead carrier 17 for longitudinally adjusting the workhead. As clearly shown in FIGS. 1 to 3, the two workheads 10 associated with each rail 7 are arranged symmetrically with respect to a vertical plane extending therebetween transversely to the longitudinal extension of the machine.

The illustrated machine further comprises pivotal carrier arm 24 for each hammer 20 and associated stripping element 21, the carrier arm being pivotal about axis 23 extending in a longitudinal direction, and drive 19 is connected to carrier arm 24 for pivoting the arm and adjusting the hammer vertically. The stripping element is arranged on carrier arm 24 transversely opposite the hammer with respect to the rail for pressing against the rail head at the gage side of the rail, and drive 30 is mounted on the carrier arm and connected to stripping element carrier 28 for transversely displacing stripping element 21 for fully detaching the partially detached tie anchor. Stripping element 21 comprises abutment face 31 arranged to extend substantially vertically for engagement with the rail head in a vertically and transversely adjusted stripping position of the stripping element, and short end portion 32 projecting from the abutment face towards associated hammer 20 at an obtuse angle to abutment face 31. The hammer is cylindrical and defines a longitudinal axis, the longitudinal hammer axis enclosing an angle of about 60° to 80° with pivotal arm 24. The lower end of hammer 20 is tapered for engagement with field-side end 34 of anchor 22.

The carrier arm extends transversely with respect to the machine frame, and hammer 20 and stripping element 21 are mounted at one end of transversely extending carrier arm 24. Substantially vertically extending lever arm 25 has one end to which an end of carrier arm 24 opposite to the one carrier arm end is linked at axis 23, and an end of lever arm 25 opposite to the one lever arm end is linked to workhead carrier 17 at pivot 26 extending longitudinally with respect to machine frame 4. Drive 27 links lever arm 25 to workhead carrier 17 for pivoting the lever arm.

The carrier arm comprises abutment 33 between hammer 20 and stripping element 21, which is arranged to engage the running surface of the rail head upon pivoting carrier arm 24 vertically donwardly towards the rail.

Above-described machine 1 illustrated in FIGS. 1 to 4 is operated in the following manner:

At the operating site, carrier frame 11 is lowered by actuating drives 35 linking the forward end of the carrier frame to machine frame 4 until flanged wheels 12 engage rails 7. At this stage, hammers 20 and stripping elements 21 of the four workheads 10 are in their raised rest position, which is shown at the right side of FIG. 4. The workheads are centered along longitudinal guide rods 18 in the position shown in FIG. 3. Drive 6 is then actuated to propel the machine along track 9 until workheads 10 are approximately centered above tie 8 from which anchors 22 are to be removed. The machine is stopped in this position, and the workheads are accurately centered by acutation of drives 16 until the hammers are in exact vertical alignment with field-side ends 34 of anchors 22. If further alignment of the hammers in a transverse direction is required, drives 27 are actuated to displace the hammers transversely.

The anchor detaching operation proceeds automatically by actuating drives 19 until resilient abutments 33, which may be of rubber or the like, engage the running surfaces of the rail heads, in which lowered operating position the tapered ends of hammers 20 press field-side ends 34 of anchors 22 downwardly out of engagement with the field-side edge of the rail base. At the same time and as shown on the left in FIG. 4, associated stripping elements 21 are lowered into the operating position between gage-side ends 36 of the anchors and the rail heads, whereupon drives 30 are actuated to press abutment faces 31 of the stripping elements against the rail heads. As soon as abutment 33 engages the rail head, drives 30 are reversed to pivot the stripping elements about axis 29, causing projecting stripping element ends 32 to engage and entrain gage-side anchor ends 36, thus fully detaching the partially detached anchors from the rail base.

The above-described sequence of automatic operations is the same for all four workheads 10 so that all four anchors at tie 8 are detached in the same operating stage. The transparent floor of cab 2 above the workheads gives an operator in the cab an excellent view of the hammers and anchors so that he can readily control the centering operations.

When the machine is propelled to the next tie from which anchors are to be detached, rotary magnetic tie anchor collecting drive 14 will automatically collect the detached anchors, which lie between rails 7 on the ballast or the ties, and conveyors 15 convey the detached anchors from device 14 to containers in a car or cars coupled to the rear end of machine frame 4. If desired, the detached anchors could be collected in any other desired manner, for instance by a separate machine following machine 1.

In the embodiment illustrated in FIGS. 5 and 6, like reference numerals designate like parts operating in a like manner as in the embodiment of FIGS. 1 TO 4. Essentially, this embodiment differs from the first-described embodiment only in that hammer 37 is structured to serve as a pressure as well as a stripping element for detaching anchor 22 from the base of rail 7. For this purpose, hammer 37 comprises a vertical part and a horizontal part projecting perpendicularly from the vertical part towards the rail and the anchor. The vertical part of hammer 37 is spaced a sufficient distance from rail 7 to permit an unhindered transverse displacement of the hammer towards the anchor in the direction of arrow 38 to press the free end of the horizontal hammer part into detaching engagement with field-side end 34 of anchor 22 to strip the anchor off the rail base (see FIG. 6). The free horizontal hammer part end has a projecting nose 39 defining recessed abutment 40. Abutment 33 on pivotal arm 24 is somewhat wider than the abutment in the first-described embodiment. Preferably, and to assure a trouble-free transverse displacement of hammer 37, the distance between abutment 33 and the upper surface of projecting nose 39 slightly exceeds the height of rail 7.

In operation, drive 19 is actuated to lower pivotal arm 24 until resilient abutment 33 contacts the running surface of rail 7, in which position projecting nose 39 engages fieldside end 34 of anchor 22 and presses the same down out of engagement with the field-side edge of the rail base (FIG. 6). Subsequently, drive 27 is actuated to displace hammer 37 transversely in the direction of arrow 38, causing the fieldside anchor end to be nestled in recessed abutment 40 and the partially detached anchor to be fully detached from the rail base. After anchor 22 has been fully detached, drive 27 is reversed so that hammer 37 returns into its rest position shown in FIG. 5 so that the machine may advance to the next operation after pivotal carrier arm 24 has been raised by drive 19.

FIGS. 7 to 9 illustrate workhead 41 for detaching anchor 42 from the base of rail 60. Workhead carrier 43 is longitudinally displaceably mounted on guide rods 44 extending in a direction extending longitudinally with respect to the machine frame, and drive 45 is linked to the workhead carrier for longitudinal displacement thereof. Guide rods 44 are affixed to carriage 46 which, in turn, is displaceable transversely with respect to the machine frame on carrier frame 47, and drive 48 is connected to the carriage for transverse displacement thereof. Substantially L-shaped hammer 49 is mounted on workhead carrier 43 and comprises vertical part 50 and horizontal part 53 projecting therefrom. Vertical hammer part 50 is vertically adjustably mounted in vertical guide 51 of workhead carrier 43, and drive 52 is connected to the vertical hammer part for vertical adjustment of the hammer. The free end of horizontal hammer part 53 carries nose-shaped pressure element 54 for engaging the field-side tie anchor end. Horizontal hammer part 53 defines guide 55 extending transversely with respect to the machine frame which glidingly holds transversely displaceable stripping element carrier body 56. Stripping element 57 is connected through a slot with carrier body 56, and drive 59 for transversely displacing the stripping element is connected to the carrier body through another slot and is affixed to hammer 49. L-shaped stripping element 57 carries pressure plate 61 at the free end of the horizontal stripping element part.

In operation and after the machine has been stopped at a tie from which anchors 42 are to be removed, drives 45 are actuated until workheads 41 have been centered so that pressure elements 54 are in vertical alignment with the anchors. If required, drives 48 may be actuated to provide the desired transverse spacing of the pressure elements from the field-side edge of the rail base so that pressure elements 54 will be in accurate vertical alignment with the field-side ends of anchors 42. Drives 52 will then be actuated to lower hammers 49 until abutments 62 contact workhead carriers 43 and prevent further downward movement of the hammers (FIG. 7). In this illustrated operating position, pressure elements 54 will press the field-side ends of anchors 42 down and out of engagement with the rail base so that the anchors will be partially detached therefrom. Contact of abutments 62 with workhead carriers 43 will automatically trigger actuation of drives 59 and cause stripping elements 57 to be transversely displaced against the partially detached anchors (see FIG. 8). Pressure plate 61 of the transversely moving stripping element will entrain partially detached anchor 42 towards the center of the track so that the anchor will be fully detached and laid on the tie or ballast next to the gage side of rail 60. As soon as stripping elements 57 have reached their forward end position, they will be retracted by reversal of drives 59 so that they will assume their rest position shown in FIG. 7. Subsequently, drives 52 will be actuated again to raise hammers 49 with their stripping elements 57 into their rest positions, in which workheads 41 are ready for the following operation.

What is claimed is:

1. A machine for detaching tie anchors from the rails of a railroad track comprising two rails fastened to ties, each rail consisting of a head, a base and a web interconnecting the rail head and base, and having a field side and a gage side, and the tie anchors engaging the rail base and having one end at the field side of the rail and an opposite end at the gage side of the rail, wherein said machine comprises (a) a self-propelled machine frame mounted on undercarriages for movement along the track in an operating direction, and (b) two workheads mounted on the machine frame and positioned opposite each other in a direction extending transversely to the machine frame, each of the workheads being associated with a respective one of the rails for detaching the tie anchors therefrom and comprising (1) a hammer arranged to press against the one tie anchor end, and (2) drive means for adjusting the hammer vertically and in a direction extending longitudinally with respect to the machine frame for pressing the hammer against the one tie end.

2. The machine of claim 1, wherein two of said workheads are associated with each rail, and the drive means comprises a respective drive connected independently to each workhead for longitudinally adjusting the workhead.

3. The machine of claim 1, further comprising a carrier frame for the workheads, the carrier frame extending in a direction extending longitudinally with respect to the machine frame and having one end linked to the machine frame, and flanged wheels supporting an opposite end of the carrier frame on the rails.

4. The machine of claim 1, further comprising a vertically adjustable magnetic tie anchor collecting device mounted on the machine frame rearwardly of each workhead in the operating direction, and a container for storing the collected tie anchors.

5. The machine of claim 1, further comprising an operator's cab mounted on the machine frame above the workheads, the cab having a width of at least 3 m and a transparent floor portion through which an operator in the cab may view the workheads.

6. The machine of claim 1, wherein the vertically adjustable hammer comprises a pressure element for engaging the one tie anchor end, a transversely displaceable stripping element, and a drive for transversely displacing the stripping element.

7. A machine for detaching tie anchors from the rails of a railroad track comprising two rails fastened to ties, each rail consisting of a head, a base and a web interconnecting the rail head and base, and having a field side and a gage side, and the tie anchors engaging the rail base and having one end at the field side of the rail and an opposite end at the gage side of the rail, wherein said machine comprises (a) a self-propelled machine frame mounted on undercarriages for movement along the track in an operating direction, and (b) two workheads mounted on the machine frame for displacement in a direction extending longitudinally with respect to the machine frame and positioned opposite each other in a direction extending transversely to the machine frame, each of the workheads being associated with a respective one of the rails for detaching the tie anchors therefrom and comprising (1) a hammer arranged at the respective rail to press against the one tie anchor end,
(2) a drive for adjusting the hammer vertically for pressing the hammer against the one tie end and partially detaching the tie anchor,
(3) a vertically and transversely displaceable stripping element associated with the hammer, and
(4) drive means for vertically and transversely displacing the stripping element for fully detaching the partially detached tie anchor.

8. The machine of claim 7, wherein two of said workheads are associated with each rail, and further comprising a respective drive connected independently to each workhead of longitudinally adjusting the workhead.

9. The machine of claim 7, further comprising a carrier frame for the workheads, the carrier frame extending in a direction extending longitudinally with respect to the machine frame and having one end linked to the machine frame, and flanged wheels supporting an opposite end of the carrier frame on the rails.

10. The machine of claim 7, further comprising a vertically adjustable magnetic tie anchor collecting device mounted on the machine frame rearwardly of each workhead in the operating direction, and a container for storing the collected tie anchors.

11. The machine of claim 7, further comprising an operator's cab mounted on the machine frame above the workheads, the cab having a width of at least 3 m and a transparent floor portion through which an operator in the cab may view the workheads.

12. The machine of claim 7, wherein the vertically adjustable hammer comprises a pressure element for engaging the one tie anchor end, a transversely displaceable stripping element, and a drive for transversely displacing the stripping element.

13. The machine of claim 7, wherein the stripping element comprises an abutment face arranged to extend substantially vertically for engagement with the rail head in a vertically and transversely adjusted stripping position of the stripping element, and a short end portion projecting from the abutment face towards the associated hammer at an obtuse angle to the abutment face.

14. The machine of claim 7, further comprising a pivotal carrier arm for each hammer and associated stripping element, the carrier arm being pivotal about an axis extending in a longitudinal direction, and the drive is connected to the carrier arm for pivoting the arm and adjusting the hammer vertically.

15. The machine of claim 14, wherein the stripping element is arranged transversely opposite the hammer with respect to the rail for pressing against the rail head at the gage side of the rail, the stripping element being mounted on the carrier arm for pivoting about an axis extending in a longitudinal direction, and the drive means comprising a drive mounted on the carrier arm for transversely displacing the stripping element for fully detaching the partially detached tie anchor.

16. The machine of claim 14, wherein the carrier arm extends transversely with respect to the machine frame and the hammer and stripping element are mounted at one end of the transversely extending carrier arm, and further comprising a substantially vertically extending lever arm having one end to which an end of the carrier arm opposite to the one carrier arm end is linked, a workhead carrier to which an end of the lever arm opposite to the one lever arm end is linked at a pivot extending longitudinally with respect to the machine frame, and a drive linking the lever arm to the workhead carrier for pivoting the lever arm.

17. The machine of claim 14, wherein the carrier arm comprises an abutment arranged to engage the running surface of the rail head upon pivoting the carrier arm vertically donwardly towards the rail.

18. The machine of claim 14, wherein the hammer is cylindrical and defines a longitudinal axis, the longitudinal hammer axis enclosing an angle of about 60° to 80° with the pivotal arm.

* * * * *